US006948644B1

(12) United States Patent
Beletsky

(10) Patent No.: US 6,948,644 B1
(45) Date of Patent: Sep. 27, 2005

(54) MOVABLE WELT HOLSTER

(75) Inventor: Robert J. Beletsky, Fallbrook, CA (US)

(73) Assignee: Bianchi International, Temecula, CA (US)

( * ) Notice: Subject to any disclaimer, the term of this patent is extended or adjusted under 35 U.S.C. 154(b) by 0 days.

(21) Appl. No.: 10/215,857

(22) Filed: Aug. 8, 2002

Related U.S. Application Data

(60) Provisional application No. 60/312,104, filed on Aug. 13, 2001.

(51) Int. Cl.[7] ..... F41C 33/02
(52) U.S. Cl. ..... 224/193; 224/243; 224/244; 224/911
(58) Field of Search ..... 224/193, 198, 224/243–245, 911

(56) References Cited

U.S. PATENT DOCUMENTS 3,252,639 A * 5/1966 Sloan ..... 224/243
4,934,574 A * 6/1990 Salandre ..... 224/244
5,282,559 A * 2/1994 Wisser et al. ..... 224/243
5,284,281 A * 2/1994 Nichols ..... 224/244
5,395,021 A * 3/1995 Brown ..... 224/244
5,570,830 A * 11/1996 Nichols ..... 224/243
5,855,305 A * 1/1999 Nichols ..... 224/244
5,944,239 A * 8/1999 Rogers et al. ..... 224/193
6,467,660 B1 * 10/2002 Rogers et al. ..... 224/243
6,641,009 B2 * 11/2003 French et al. ..... 224/244

* cited by examiner

*Primary Examiner*—Nathan J. Newhouse
(74) *Attorney, Agent, or Firm*—John E. Wagner; Sam Bernardo

(57) ABSTRACT

A holster for carrying a handgun having a movable welt which reduces the likelihood that the handgun will be the subject of either an accidental or intentional dislodgment. The movable welt rotates about 10° to 15°, and as it rotates, the handgun is moved from a position where its hammer region is secured by a fixed strap and the weapon may not be removed to a position where the strap is no longer an issue and the weapon may be removed.

26 Claims, 8 Drawing Sheets

MOVABLE WELT HOLSTER

REFERENCE TO RELATED APPLICATION

This non-provisional patent application claims benefit of U.S. provisional patent application Ser. No. 60/312,104 filed Aug. 13, 2001, and hereby claims the benefit of the embodiments therein and of the filing date thereof.

BACKGROUND OF THE INVENTION

Although holsters differ in size, shape and materials of construction, the basic concept is the same; a holster is a cavity for receiving, holding, and protecting a handgun, while allowing it to be easily and rapidly drawn when needed.

The advent of the holster brought about new concerns, the most significant being how to keep the handgun holstered, especially when the wearer engages in vigorous physical activity. The ability of the holster to retain its weapon is of particular importance to law enforcement and military personnel. The accidental dislodgment of the handgun from its holster may place the holster wearer's life in danger as a loss of weapon reduces the individual's ability to defend himself. Similarly, the unauthorized withdrawal of the handgun from the holster by adversaries may also place the individual in danger of serious injury or death.

Consequently, holster designers are confronted with a serious dilemma. On the one hand, the wearer must have both a holster, which readily and easily accepts a handgun, and also provides for ease of withdrawal of the weapon. On the other hand, the holster must be capable of retaining the handgun during almost any type of physical activity which the holster wearer may engage in; and finally, the holster must be able to resist intentional attempts by third persons to remove the weapon from the holster. It has proven a challenge for holster manufacturers to design a holster which allows the wearer easy access to his weapon, while also securing the weapon from accidental or intentional dislodgment.

BRIEF DESCRIPTION OF THE INVENTION

The present invention is concerned with a holster for carrying a handgun, which reduces the likelihood that the handgun will be subject to either accidental dislodgment or third party take away while concurrently providing the wearer with the ability to quickly and easily remove and re-holster the handgun. The inventive holster may be carried or attached as any traditional belt worn or may be adapted as a shoulder worn holster.

The holster of this invention features a permanently fixed, semi-rigid strap, a movable welt and a trigger guard retention device. The handgun rests upon or against the movable welt assembly within the holster cavity, which cradles the weapon. The handgun is also be held in place within the holster by the trigger guard retention device.

The movable welt assembly of this invention replaces the common fixed welt, which can be found in most holsters where the two longitudinal sides of the holster are actually sewn or otherwise secured adjacent to the trigger region of the handgun. The movable welt assembly may be of several materials, such as metal or a rigid plastic, and in the preferred embodiment is pivotable about its lower end in the region of the handgun muzzle and slidable a distance in the direction of the handgun muzzle to release the movable welt assembly at its upper end.

The movable welt assembly includes a generally U-shaped cam groove with the legs of the U defining two stop positions, welt assembly closed or welt assembly open. The channel region of the cam groove lies between the legs of the U-shaped cam groove and guides a pin or screw fastener as the movable welt rotates, e.g., about 10° to 15° from the welt assembly closed position to the welt assembly open position. The angle of rotation of the movable welt assembly is sufficient to allow the hammer region of the handgun to pivot clear the fixed strap and thus allow the handgun to be removed from the holster.

The movable welt assembly, being rigid and adjacent the trigger guard, also provides an ideal location for securing a trigger guard retainer.

When the holster is in the handgun secure position, the hammer region of a revolver handgun or semi-automatic weapon fits snugly against the interior of the rigid strap. The strap is fixedly positioned and does not move or open. A handgun within the inventive holster, which is in the handgun secure position, cannot be removed without first requiring an individual to forcibly remove the strap from the back of the weapon, and such is difficult to do. Consequently, a handgun secured within the inventive holster is not likely to be removed, either by the conduct of the wearer or by any intentional conduct of third persons.

To remove the handgun from the inventive holster, the movable welt assembly must be moved out of the welt closed position so the cam groove may be engaged. Grasping the handgun grip and pressing the handgun downward a distance, e.g., about ¼ to ½ inch, frees the cam pin from the welt assembly closed position and allows the cam pin to move along the cam groove and thus allows the movable welt assembly to rotate backwards about 2 inches. The backward rotation of the movable welt assembly moves the handgun out from under the fixed strap, and positions the cam pin in the welt assembly open position. At this time, the handgun is resting upon the movable welt assembly and is loosely held in place by the sides of the holster cavity and the trigger guard retention device. Pulling upwards on the handgun after rotation of the movable welt, as would be done to remove a handgun from a traditional holster, releases the trigger guard from the trigger guard retention device and the weapon is free from the holster of this invention. To replace the weapon, these steps are carried out in reverse. This welt may also be slidable.

The holster resists the accidental dislodgment or intentional removal of a weapon by a third person, while at the same time providing the wearer with the ability to quickly and easily remove and re-holster a weapon.

BRIEF DESCRIPTION OF THE DRAWINGS

This invention may be more clearly understood with the following detailed description and by reference to the drawings in which.

DETAILED DESCRIPTION OF THE INVENTION

Many holsters are made from a single piece of material, such as leather or the like, with two sides, an outer face 13(*o*), an inner face 13(*i*) folded together to form a handgun-receiving pocket or cavity. The edges, which come together to complete the pocket, are often attached to each other. A spacer, usually of leather or the like, between the two sides is connected to form the holster pocket which is commonly referred to as the holster welt. This inventive holster replaces the traditional fixed welt design with a movable welt, which also acts as a handgun retention device.

Figure 1:
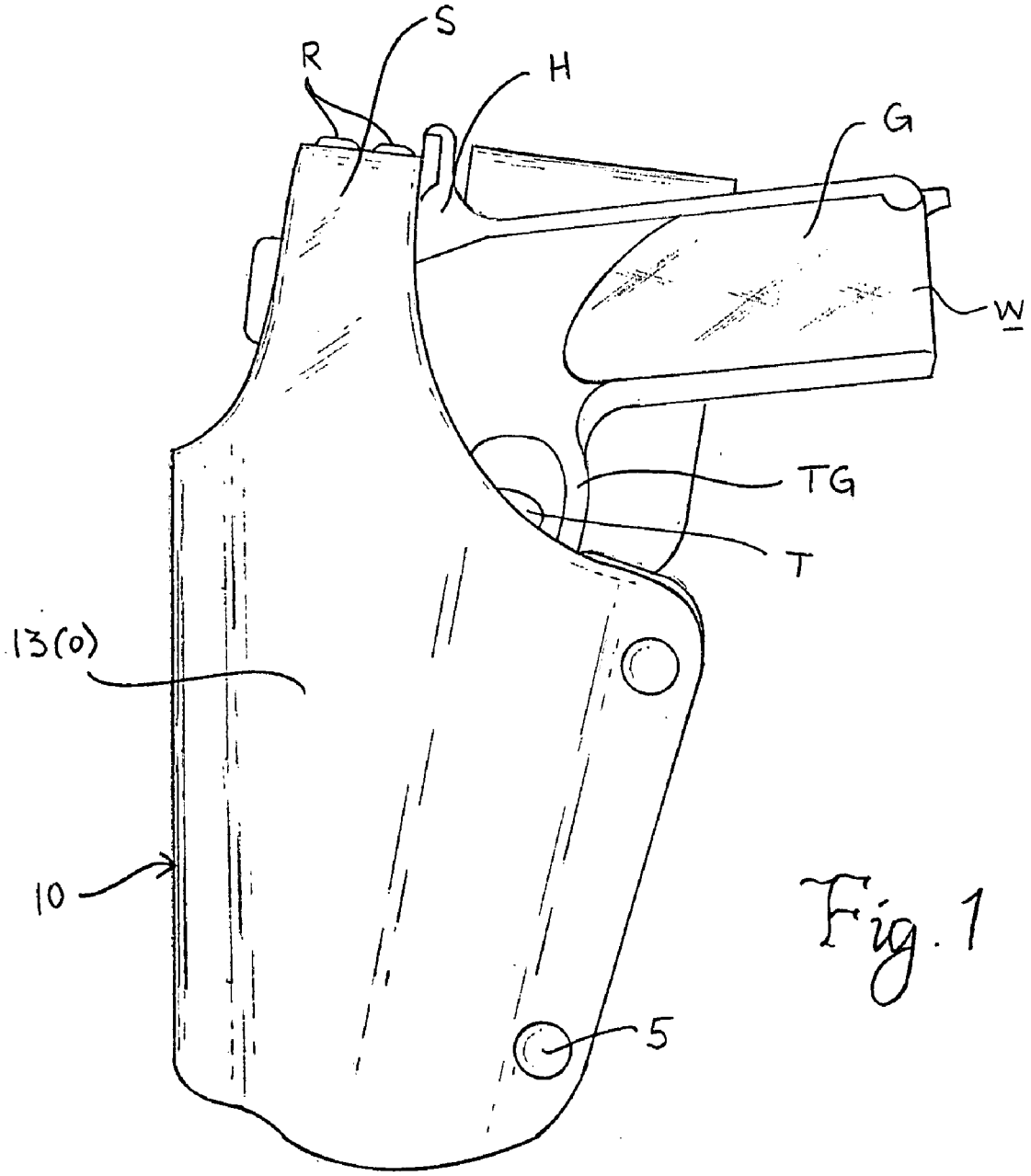
FIG. 1 is an outer side elevational view of the inventive holster with an automatic handgun in place.
Figure 2:
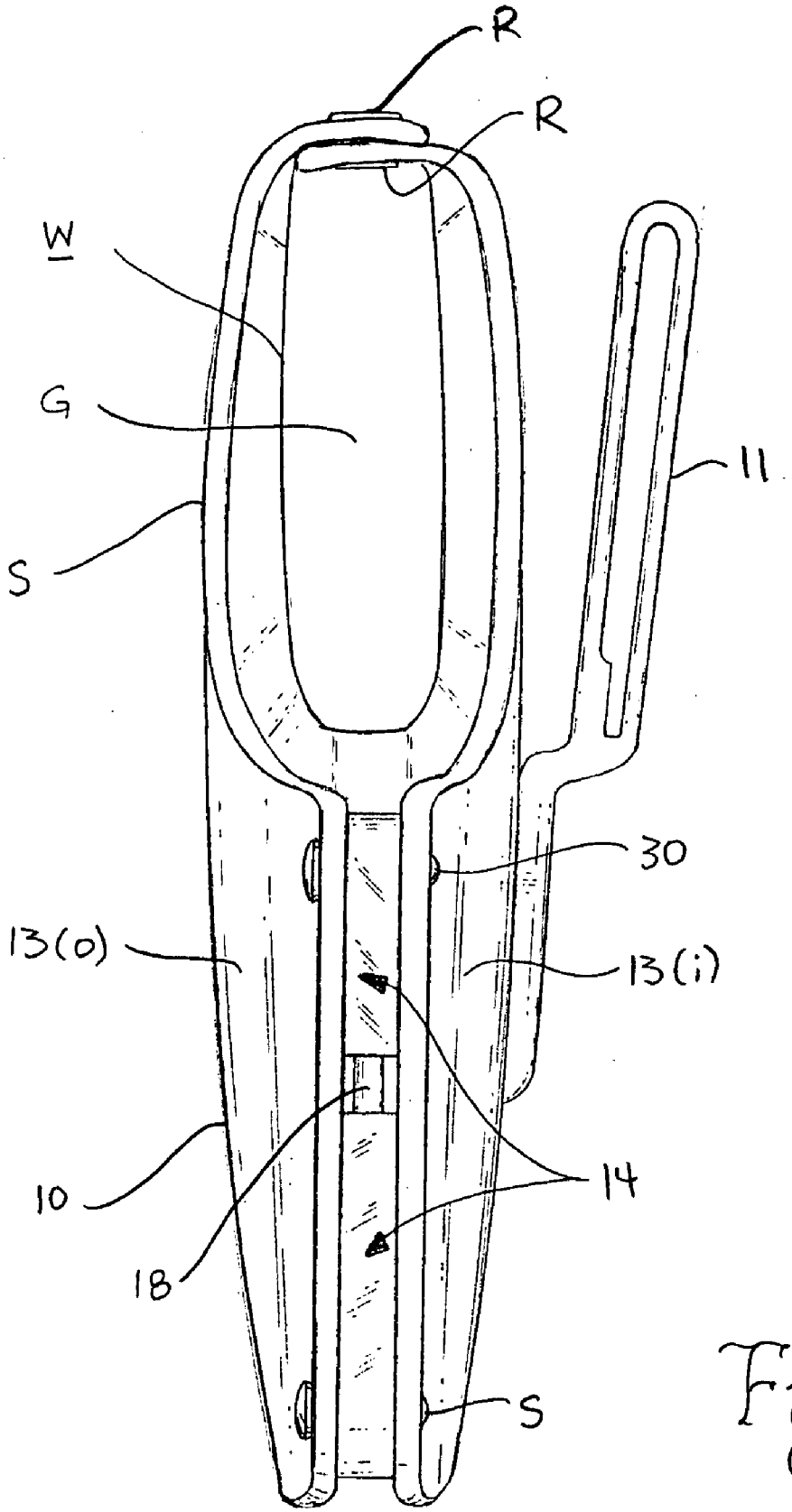
FIG. 2 is a rear elevational view of the inventive holster illustrating the movable welt assembly.

The holster of this invention, generally designated 10, appears in FIGS. 1 and 2 as a fairly standard, belt-worn duty holster having an outer face 13(*o*) and a strap S. The holster's welt, best seen in FIGS. 2–8, appears to be a traditional rigid welt, and there is no holster front opening. The handgun W of FIG. 1 is shown with its hammer region H secured by a solid, permanent holster strap S. The ends of the strap S are attached to each other by fastener means; however, the preferred means is by way of rivets R, best seen in FIG. 2. In FIG. 2, a belt loop assembly 11 and the movable welt 14 of this invention may also be seen.

To the observer viewing the outer face 13(*o*) or the front of the holster 10, there is no visible means for releasing the strap and thus it appears no means for removing the weapon. Consequently, the holster of this invention psychologically appears to be unassailable to would-be aggressors. For an understanding of the actual handgun release mechanisms of this invention, one must turn to FIGS. 3–9, which illustrate the best embodiment of the invention.

In FIGS. 1 and 2, the holster 10 appears to be closed by rivet-like appearing fasteners, labeled in these figures as 5 and 30, the function of which will be explained below. The trigger guard TG of the handgun and the trigger T may also be seen in FIGS. 1 and 3–9.

Figure 3:
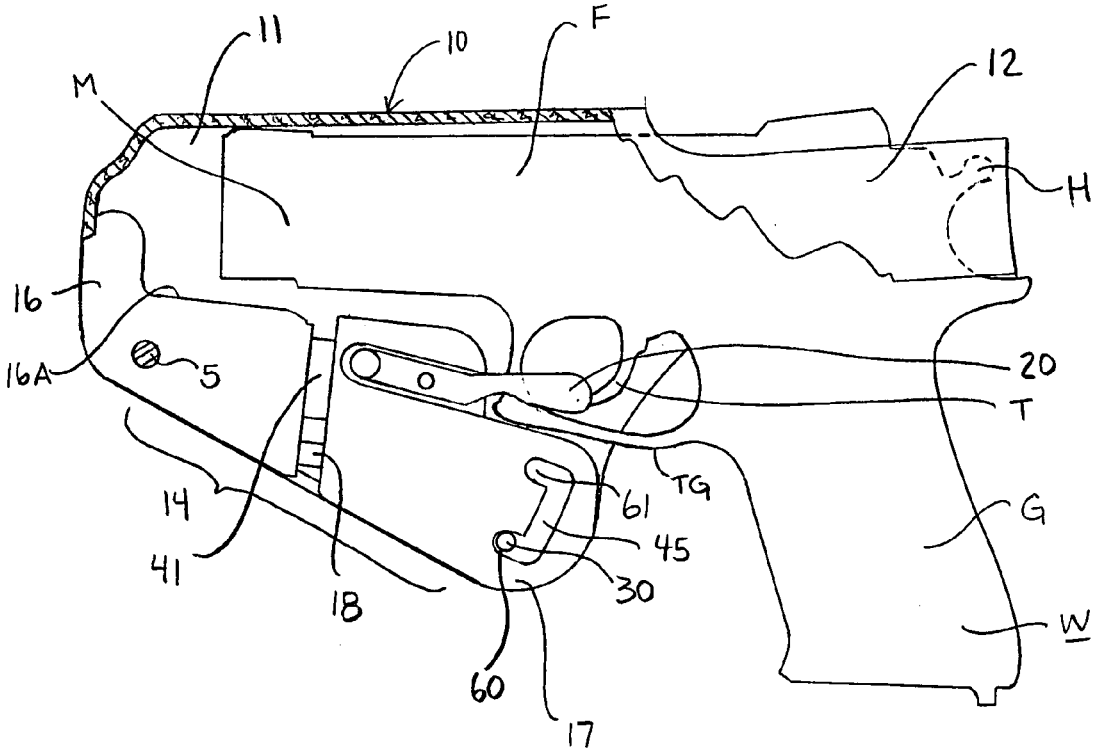
FIG. 3 is a side elevational view of the inventive holster shown partly broken away with automatic handgun, illustrating the movable welt assembly in the closed position, and specifically showing the cam pin arrangement.
Figure 4:
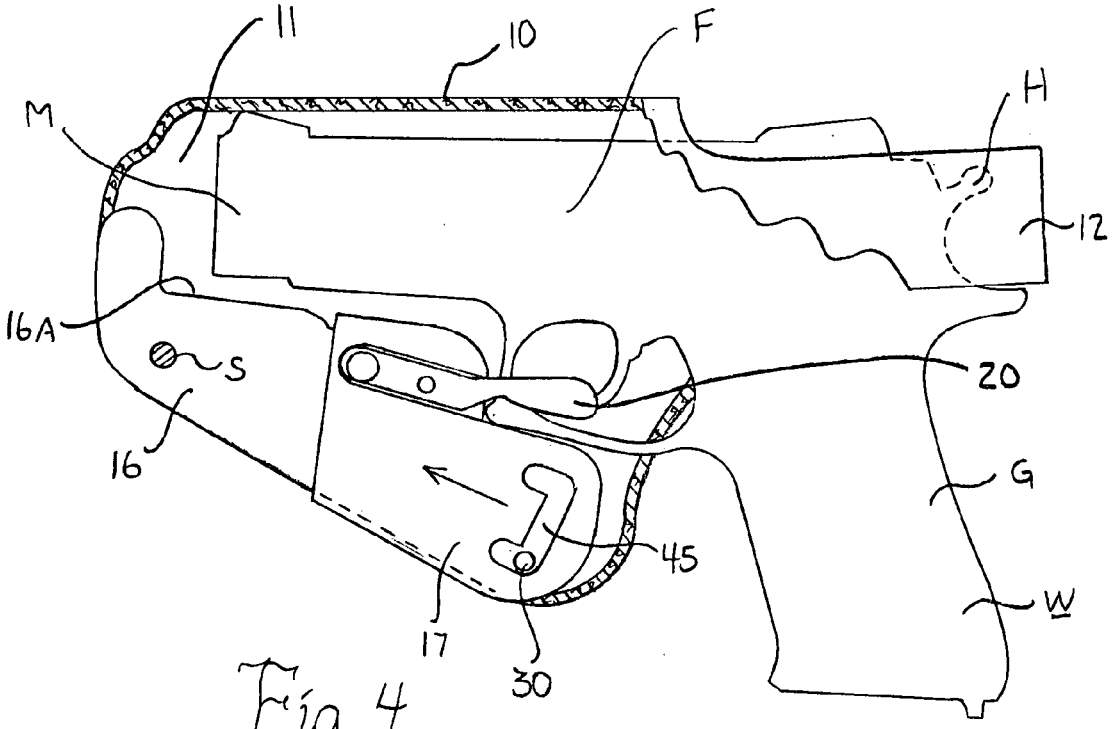
FIG. 4 is the holster and handgun of FIG. 3 after the movable welt has been depressed in the direction of the arrow showing the cam pin in the released position within a cam groove.
Figure 5:
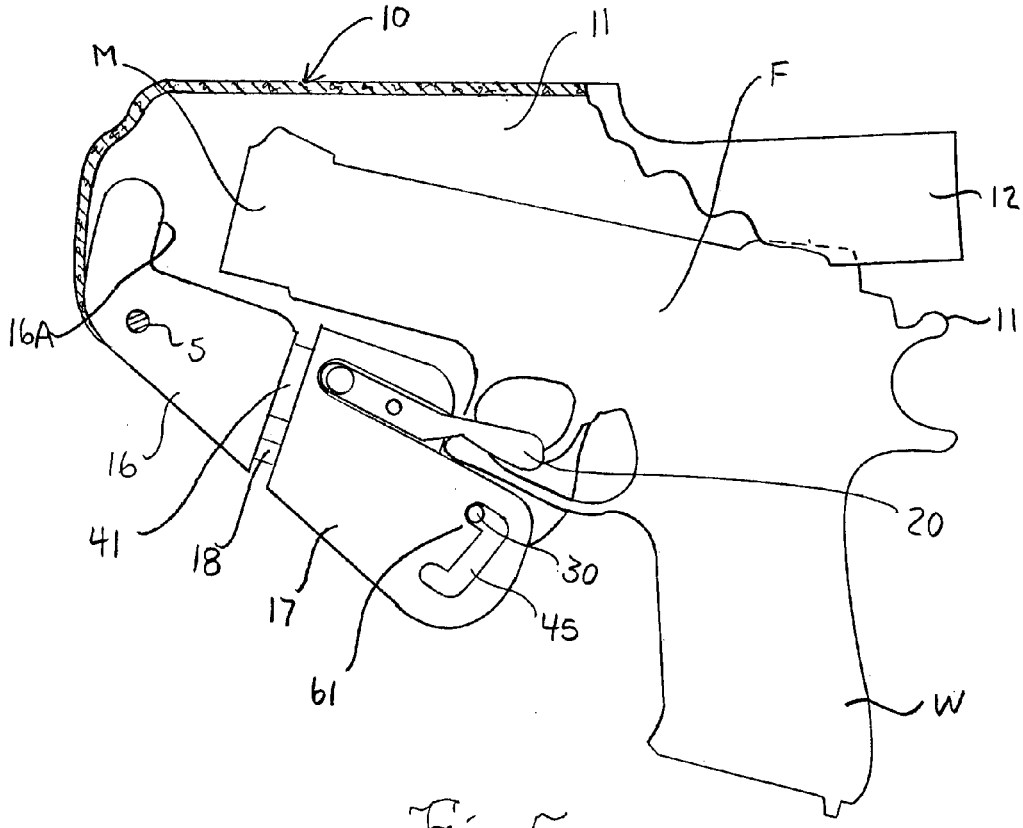
FIG. 5 is the holster and handgun of FIG. 3 after the movable welt has been depressed and rotated backward, showing the cam pin and thus movable welt assembly and holster in the open position.

FIGS. 3, 4, and 5 collectively illustrate the movement of movable welt assembly 14 and specifically show the corresponding movement of handgun W. FIG. 3 illustrates the holster 10 shown with a semi-automatic handgun W in place and portions of the holster broken away to show the movable welt assembly 14. As mentioned earlier, the outward appearance of holster 10 is reminiscent of most duty-type holsters. The functional aspects of holster 10 include cavity or pocket 11 for carrying weapon W with its hammer H and trigger T. Muzzle region M, frame or slide F, grip G, movable welt assembly 14, or holster 10 providing the means for retaining and removing handgun W from the holster 10. Fixed strap 12 secures the weapon W within holster cavity 11 from upward removal, and an internal, concealed trigger guard retention device 20 also provides for securing weapon W within holster 10.

In the preferred embodiment, movable welt assembly 14 is comprised of two sections, the weapon muzzle retention section 16 and the trigger guard section 17, best seen in FIGS. 3–8. These two sections are connected by pin 18 and spring housing member 41, both of which will be discussed in more detail in connection with FIGS. 6 and 7. FIG. 3 also illustrates movable welt assembly 14 in a closed or handgun secure position, with the weapon W secured by fixed strap 12, trigger guard retainer 20 and the movable welt assembly 14, which closes the pocket 11 from handgun removal unless the welt assembly 14 moves.

Strap 12 is fixed and quite rigid and will not move unless subjected to extreme force. As is shown in FIG. 3, the movable welt assembly 14 is maintained in the handgun secure position by pins 5 and 30, which appear in FIG. 1 like simple rivets. Hammer region H of the automatic weapon W rests securely against and is restrained by the interior surface of strap 12. Thus, handgun W of FIG. 3 is shown to be fixedly positioned within holster cavity 11 and cannot be removed from holster 10 unless welt assembly 14 is depressed and rotated outward or the fixed strap 12 is somehow removed.

FIG. 3 illustrates the mechanics of the movable welt assembly 14 as being hidden by the outer face 13(*o*) of holster body 10 and not easily recognizable by the public at large. Thus, inventive holster 10 gives the illusion that strap 12 must first be removed before weapon W may be withdrawn. Consequently, third persons who are attempting an unauthorized weapon take-away may incorrectly focus their effort on removing strap 12, which has no means for opening and is, therefore, not easily removed. Additionally, the hammer H may not be cocked while under the strap 12.

FIG. 3 also illustrates trigger guard retention device 20 of the type disclosed in U.S. Pat. No. 5,129,562 to John Bianchi. It is acknowledged that other weapon retention devices may also be employed in conjunction with inventive holster 10. The addition of the trigger guard retention device 20 to this combination is another feature of the inventive holster 10, which helps to keep handgun W from accidental or intentional dislodgment even when the movable welt 14 is in its open position.

As illustrated in FIGS. 4 and 5, weapon W is removed by grasping the handgun grip G in a drawing position and pressing downward when the holster is belt worn, causing the cam section 13 and trigger guard retainer 20 of movable welt assembly 14 to be depressed so that a cam follower pin 30 is released from the welt locked or closed position of FIG. 3 and moves into the cam channel or track region 45. Now the entire welt assembly 14 is free to rotate about fixed pin or screw 5 which engages section 16 of movable welt assembly 14 and allows the welt assembly 14 to rotate outward. FIG. 4 further illustrates hammer region H of weapon W no longer concealed under strap 12.

The user then rotates the weapon W rearward about 10 to 15 degrees sufficient for hammer region H of weapon W to clear fixed strap 12, and cam pin 30 moves along channel region 45 into the welt assembly open position, as shown in FIG. 5. Such movement of the welt assembly 14 with respect to screw fastener 30 allows movable welt assembly 14 to rotate backward about pin or screw fastener 30. Upward movement of the user's hand and arm allows the weapon W to be withdrawn in a normal manner overcoming the restraint of the trigger guard retainer 20.

Movable welt assembly 14 and pin 30 remains in the welt assembly open position of FIG. 5 until the weapon is returned to holster 10 in the reverse series of moves. Namely, introducing the barrel, slide and muzzle region 11 of the weapon W into the open holster cavity 11 until the weapon trigger guard TG engages the trigger guard restraint 20 and is engaged. Further, downward movement of the weapon W depresses the cam section 17 of movable welt assembly 14 against its internal spring 18 described below in connection with FIG. 8.

The weapon W may now be pivoted forward in the holster 10 until the hammer H is secure beneath fixed strap 12 of holster 10. Upon release of the weapon grip, cam section 17 of movable welt assembly 14 moves upward in response to the internal spring 18 pressure. Cam pin 30 is now engaged in the welt assembly closed position as in FIG. 5. Now weapon W is secured within holster 10 by strap 12, the trigger guard retainer 20 and the closed movable welt assembly 14. The muzzle M of weapon W rests on the shelf or muzzle retention stop portion 16A of weapon stop section 16, and hammer H of weapon W is restrained by fixed strap 12. This combination of retention elements is believed to provide a high degree of weapon security.

FIGS. 3, 4, and 5 also illustrate the range or angle of motion of a movable welt assembly 14 of approximately 10–15 degrees. The range is essentially determined by the distance between the welt assembly closed position and the welt assembly open position of cam path 45. In the preferred embodiment, for a duty-type holster carrying a Smith & Wesson medium frame semi-automatic handgun, the pivot angle of the welt assembly from secure holstered position to draw position is about 15°.

Figure 7:
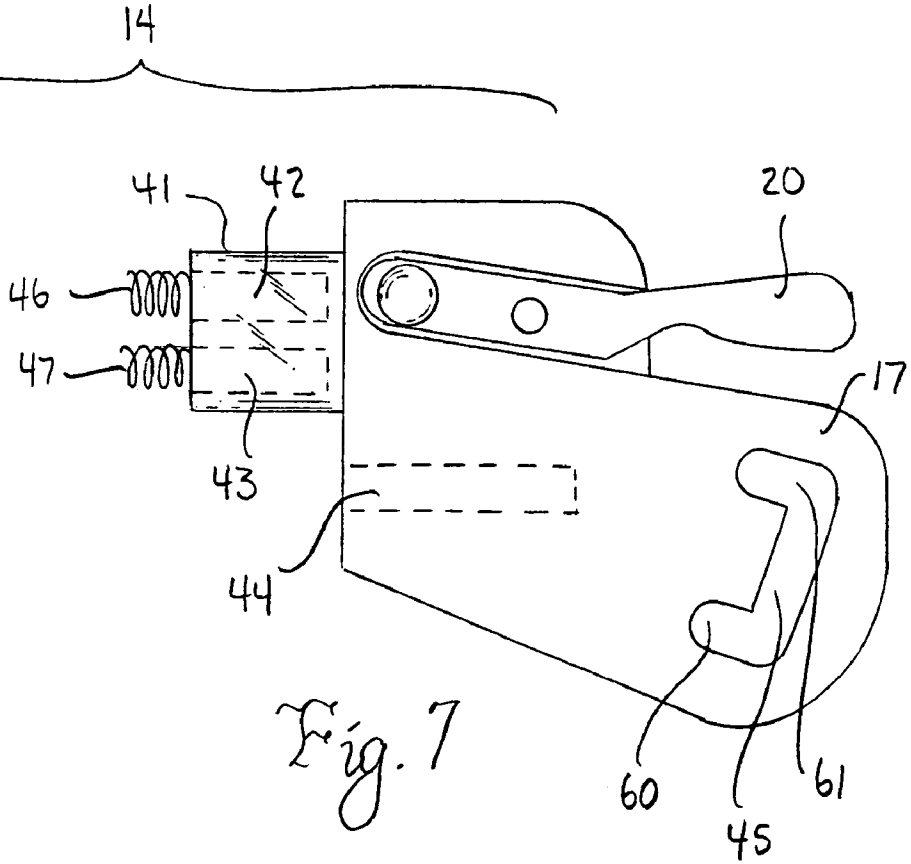
FIG. 7 is a side view of the cam section of the movable welt assembly.
Figure 6:
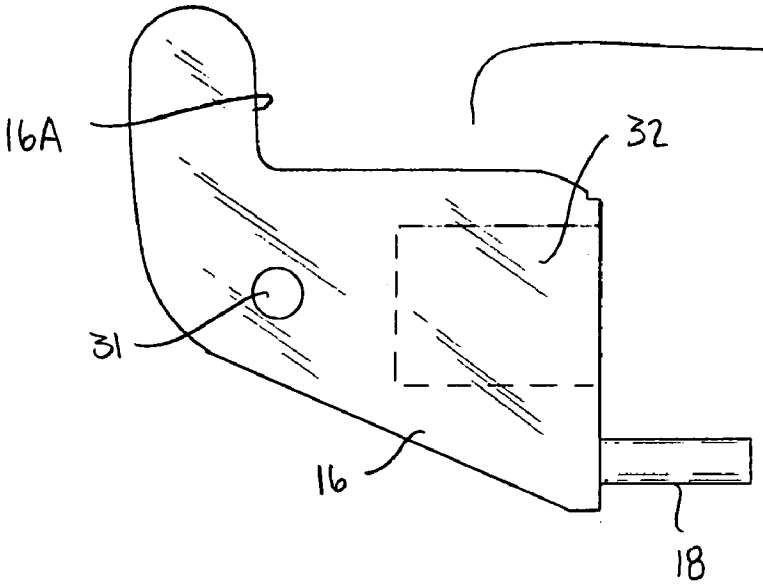
FIG. 6 is a side view of the muzzle stop section of the movable welt assembly.

For further understanding of the actual sections comprising movable welt assembly 14, attention is directed to FIGS. 6 and 7. FIG. 6 illustrates the weapon 16A stop section 16 of movable welt assembly 14 having a muzzle retainer section or stop 30, an opening 31 for pin or screw fastener 5 (not shown), a dowel or pin 18 of FIGS. 2, 3, 5, 6, and 8, and a spring housing cavity 32 shown in dashed lines in spring housing member 41. Permanent screw fastener or pin 5 shown in FIGS. 3, 4, 5, and 8 passes through opening 31 and attaches the edge portions of holster 10 to form cavity 11 and also acts as the pivot for rotating movable welt assembly 14.

Turning now to FIG. 7, which illustrates cam section 17 of movable welt assembly 14. Cam section 17 includes spring housing member 41, two spring cavities 42 and 43, shown in dashed line, pin cavity 44, shown in dashed line, cam track region 45, trigger guard retention device 20, and two springs 46 and 47, shown partially extending out of spring cavities 42 and 43.

Guide pin 18 of weapon muzzle stop section 16 is designed to be received by cavity 44 of cam section 17. Spring housing cavity 32 of muzzle retention or stop section 16 is designed to receive spring housing member 41 of cam section 17 and aligns the welt assembly portions 12 and 13 for smooth compressive or telescoping movement.

Springs 46 and 47 are placed into spring cavities 42 and 43, respectively. Spring housing member 41 of cam section 17 is placed into spring housing cavity 32 of muzzle stop section 16, while pin 18 of weapon stop section 16 is placed into cavity 44 of cam section 17.

Cam follower pin 30, best seen in FIGS. 3, 4, 5, and 8, extends through cam track 45 and with pin or fastener 5 attaches the faces 13(*o*) and 13(*i*) of holster body 10 to complete cavity 11 and also acts to engage welt assembly 14 in the closed or open positions. Cam track or cam region 45 is an inverted U-shape having a welt assembly closed position 60 at one leg of the U and a welt assembly open position 61 at the opposite leg of the U and a transfer or intermediate section 45 therebetween. Springs 46 and 47 bias cam section 17 apart from weapon stop section 16, such that pin or screw fastener 30 cannot move from either the locked-closed position 60 or locked-open position 61 without an opposite force greater than that of springs 46 and 47 being exerted, thus allowing screw fastener 30 to move along cam path or cam region 45 of the cam section 17, best seen in FIGS. 8*a*, 8*b*, and 8*c*. The pin 30 acts as a selective lock, either holster open or holster closed depending upon which leg 60 or 61 of the inverted U it is in. The distance which movable welt assembly 14 can rotate is basically equal to the length of the cam path region or transfer section 45.

Figures 8A, 8B, 8C:
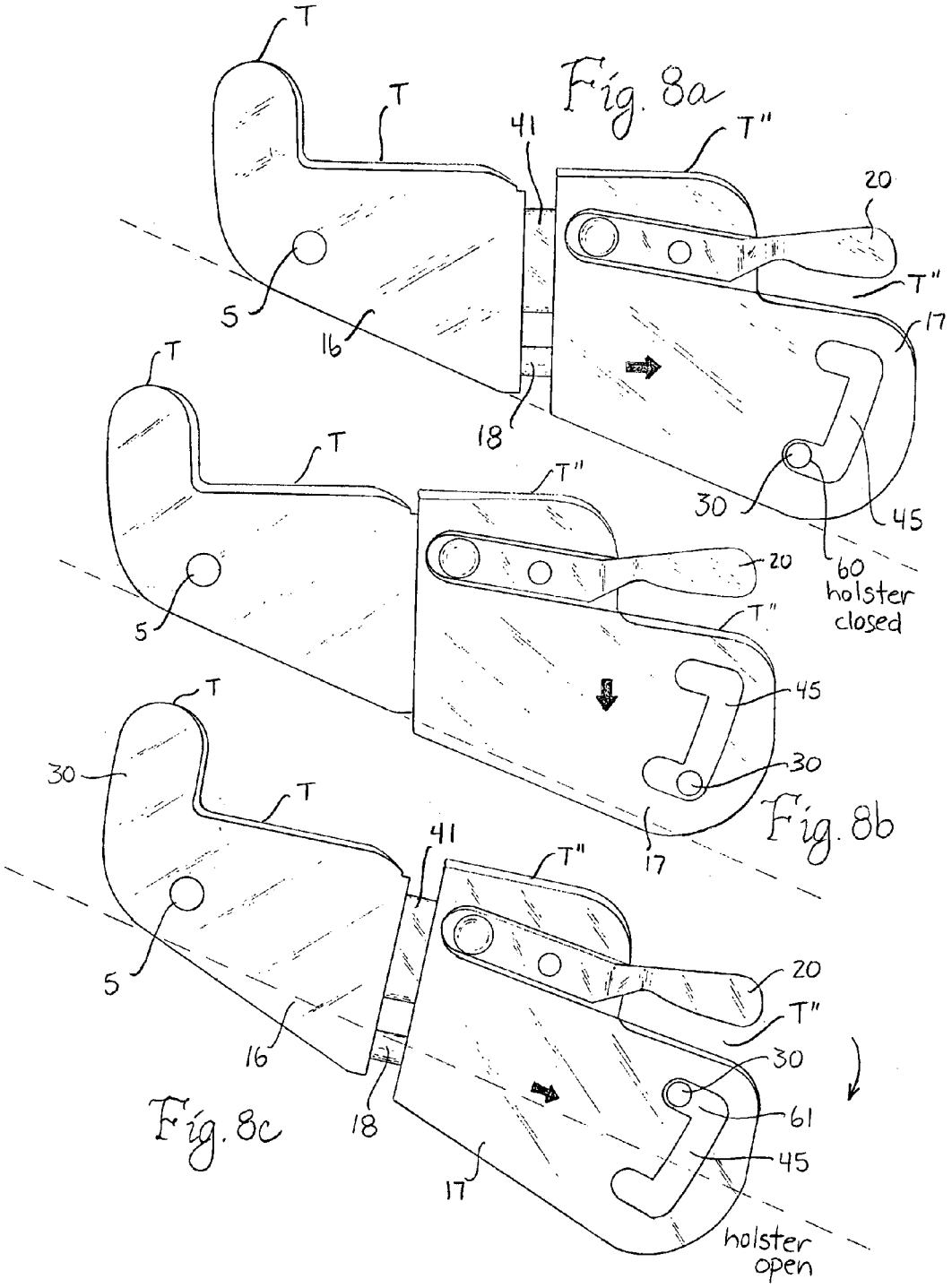
FIG. 8 is comprised of FIGS. 8*a*, 8*b*, and 8*c*, which illustrate the cam pin in the welt assembly closed, handgun secure position (8*a*), the cam pin in the released position (8*b*), and the cam in the welt assembly open position (8*c*)

FIGS. 8*a*, 8*b* and 8*c* focus upon the movable welt assembly 14 and illustrate pin or screw fastener 30 in the welt assembly closed position 60 (FIG. 8*a*), force exerted on welt assembly 14 as shown by arrow, causing screw fastener 30 to engage the channel region of cam path 45 (FIG. 8*b*) and a backward (downward in FIG. 8*b*) force exerted upon welt assembly 14 as shown by arrow, illustrating the downward rotation of the entire movable welt assembly 14, about pin 5, with pin or screw fastener 30 now in the welt assembly 14 open position 61 (FIG. 8*c*).

The top surface T of weapon stop section 16, as well as the top surface T" of cam section 17, may include a soft material of suede leather or the like to protect the handgun's exterior finish.

Figure 9:
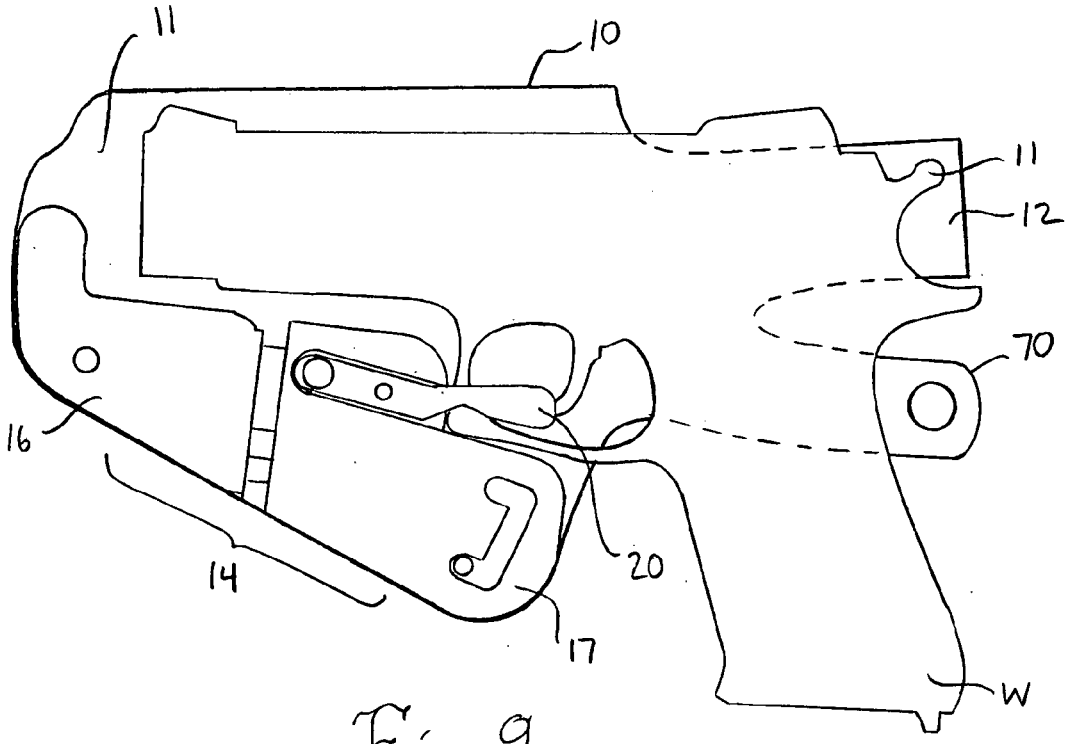
FIG. 9 shows an alternative embodiment of the movable welt holster with a thumb break-type strap.

FIG. 9 illustrates another embodiment of the inventive holster 10 including a thumb break 70 as described in U.S. Pat. No. 4,270,680 issued Jun. 2, 1981, to John Bianchi. This figure illustrates that this invention may be used in a thumb break-type holster as well. It is acknowledged that other secondary weapon security devices may be attached to inventive holster 10.

The above-described embodiments of the present invention are merely descriptive of its principles and are not to be considered limiting. The scope of the present invention instead shall be determined from the scope of the following claims including their equivalents.

What is claimed is:

1. A movable welt holster for carrying a handgun comprising:

a body of material with an outer face, an inner face, and with edge regions to define a holster pocket with an opening for the entrance and exit of a handgun;

a welt between the said pair of edge regions of said body, said welt including a trigger guard retainer;

said welt being movable with respect to the edge regions of said body of material to enlarge the size of the holster pocket to facilitate placement and removal of a handgun in the holster pocket and returnable to its position between said pair of edge regions in handgun restraining position.

2. A movable welt holster as recited in claim 1 wherein said body of material includes a fixed strap which extends above and over a portion of the holster pocket opening to retain a handgun in said holster, said strap having a faux-snap fastener thereon to provide the illusion that said strap may be opened.

3. A movable welt handgun in accordance with claim 1 wherein said holster body includes an integral strap enclosing at least a portion of said holster pocket opening.

4. A movable welt holster in accordance with claim 3 wherein said strap is fixed to said holster body and defines a permanent restraint for a holstered handgun with said welt in place between said pair of edge regions.

5. A movable welt holster for carrying a handgun comprising:

a body of material with edge regions folded together to define a holster pocket with a front face and a rear face and defining an opening for the entrance and exit of a handgun;

a movable welt between the edge regions of said body, said welt and including a cam section and a muzzle retaining section carried in compressed engagement, wherein rotation of said welt may occur when the cam section and the muzzle-retaining section are in compressed engagement; and spring means biasing said muzzle-retaining section and said cam section apart.

6. A movable welt holster as recited in claim 5 wherein said welt includes a trigger guard retainer.

7. A movable welt holster for carrying a handgun comprising:

a body of material with an outer face, an inner face, and with edge regions to define a holster pocket with an opening for the entrance and exit of a handgun;

a welt between the said pair of edge regions of said body;

said welt being of rigid material and movable with respect to the edge regions of said body of material to enlarge the size of the holster pocket to facilitate placement and removal of a handgun in the holster pocket and returnable to its position between said pair of edge regions to retain the handgun in the holster when said welt is in its aforementioned position.

8. A movable welt holster in accordance with claim 7 wherein said movable welt includes a trigger guard retainer.

9. A movable welt holster in accordance with claim 7 wherein said movable welt is pivoted about said holster body in the muzzle region of a holstered handgun.

10. A movable welt holster for carrying a handgun comprising:

a body of material with edge regions folded together to define a holster pocket with a front face and a rear face and defining an opening for the entrance and exit of a handgun;

a movable welt between the edge regions of said body;

said welt including a handgun muzzle retaining section; and a pivot member secured to said handgun muzzle retaining section such that said welt is pivotably mounted on said pivot member.

11. A movable welt in accordance with claim 10 wherein said movable welt includes a trigger guard retainer.

12. A movable welt holder as recited in claim 10 wherein said welt comprises a means for selectively locking said welt so it is not movable.

13. A movable welt holster as recited in claim 10 wherein said body of material includes a strap which extends above and over a portion of the holster pocket opening.

14. A movable welt holster as recited in claim 13 comprising a faux snap on the strap of said body to provide the illusion that the strap may be opened.

15. A movable welt holster as recited in claim 10 wherein said movable welt includes a cam section and wherein rotation of said welt may occur when the cam section and the muzzle-retaining section of said welt are in compressed engagement.

16. A movable welt holster in accordance with claim 15 including spring means biasing said muzzle-retaining section and said cam section apart.

17. A movable welt holster as recited in claim 15 comprising a handgun trigger guard retainer attached to the cam section of said welt.

18. A movable welt holster as recited in claim 15 wherein a portion of the cam section and a portion of the muzzle section of said welt assembly includes a soft covering to avoid scratching the handgun.

19. A movable welt holster for carrying a handgun comprising:

a body of material with two opposite edge regions folded together to define a holster pocket with an opening for the entrance and exit of a handgun;

a welt assembly securing the edge regions of said body;

a strap attached to said body in which said strap extends above and over a portion of the holster pocket opening;

said welt assembly including a muzzle retention section and a trigger guard retention section where the muzzle retention section and the trigger guard retention section are in movable connection with respect to each other;

the muzzle retention section having a pivot about which the welt assembly may be rotated outwards relative to the opening;

the welt assembly including a cam track defining the degree of rotation of the welt; and said body including pin means engaging said cam track, whereby said pin means and cam track limit the movement of said welt assembly.

20. A movable welt holder as recited in claim 19 wherein said welt assembly comprises a means for selectively locking said assembly so it is not movable.

21. A movable welt holster as recited in claim 19 comprising a handgun trigger guard retainer attached to the cam section of said welt assembly.

22. A movable welt assembly as recited in claim 19 comprising a faux snap on the strap of said body to provide the illusion that the strap may be opened.

23. A movable welt holster as recited in claim 19 wherein at least a portion of the cam section and a portion of the muzzle-retention section of said welt assembly include a soft covering to avoid scratching the handgun.

24. A movable welt holster as recited in claim 19 wherein said strap includes a thumb break.

25. A movable welt holster in accordance with claim 24 wherein said cam track has an inverted U-shape with two legs and an intermediate section.

26. A movable welt holster in accordance with claim 25 wherein one of said legs of the cam track defines a welt closed position and a second of said legs defines a welt open position.

* * * * *